US006604247B2

(12) United States Patent
Chiang

(10) Patent No.: US 6,604,247 B2
(45) Date of Patent: Aug. 12, 2003

(54) SWIMMING GOGGLES

(76) Inventor: Herman Chiang, 11F-2 No. 634-9 Ching-Ping Rd., Chung-Ho City Taipei Hsien (TW)

( * ) Notice: Subject to any disclaimer, the term of this patent is extended or adjusted under 35 U.S.C. 154(b) by 0 days.

(21) Appl. No.: 09/858,006

(22) Filed: May 14, 2001

(65) Prior Publication Data

US 2002/0166158 A1 Nov. 14, 2002

(51) Int. Cl.[7] ..... A61F 9/02
(52) U.S. Cl. ..... 2/428
(58) Field of Search ..... 2/428, 430, 440, 2/442, 444, 446

(56) References Cited

U.S. PATENT DOCUMENTS 5,901,382 A * 5/1999 Chiang ..... 2/445
6,023,791 A * 2/2000 Chiang ..... 2/441
6,151,720 A * 11/2000 Chiang ..... 2/428
6,289,523 B1 * 9/2001 Chiang ..... 2/428
6,321,390 B1 * 11/2001 Chiang ..... 2/428

* cited by examiner

*Primary Examiner*—John J. Calvert
*Assistant Examiner*—Katherine Moran
(74) *Attorney, Agent, or Firm*—Troxell Law Office PLLC

(57) ABSTRACT

A pair of swimming goggles includes two lens frames, a nose bridge, two gasket units and a head strap, each of lens frame has at least one concave cavity which are disposed on a periphery of each lens frame and each of which the concave cavity has a opening is disposed toward a contact side of each lens frame, and each of gasket has a foam layer and a resilient layer in which the foam layer is attached to the periphery of the rear lens frame of each lens frame to provide seal up the concave cavity, and the resilient layer is attached to the foam layer for attachment on the periphery of a wearer's eyehole, thereby providing a buoy of the swimming goggles since it is lost weight to each lens frame by the concave cavity such the swimming goggles can provide a good hermetic and comfortable fitting when the swimming goggles are in use.

15 Claims, 4 Drawing Sheets

SWIMMING GOGGLES

FIELD OF THE INVENTION

The present invention relates to a swimming goggles, in particular to a improvement structure of a swimming goggles is equipped with a light body which can be buoyed in water that can get more comfortable and compliant to the periphery of a wearer's eyehole.

BACKGROUND OF THE INVENTION

Such a property is a basic requirement for the gasket of a swimming goggles, which is achieved hermetic and water leakage-proof attachment to the periphery of a wearer's eyehole, that it should be capable of expelling the air between the gasket of the swimming goggles and the periphery of a wearer's eyehole rapidly when the swimming goggles are in use, leads to the contact side of the gasket to match and comply with the periphery of a eyehole, so as to provide the gasket tightly engagement with the periphery of a eyehole. Conventionally, the gasket of a swimming goggles have two types, the first one is made of foam material and the second one comprise a suction cup. Since the foam gasket is generally formed as a block, it can not rapidly pressure the foam gasket to compliantly engage with the periphery of a eyehole and expelled only a little air from inside of the swimming goggles, thereby reducing the foam gasket to tightly mantle with the periphery of a eyehole and can not indeed prevent the seepage of water when the swimming goggles are in use.

The suction cup gasket is usually made of rubber or thermoplastics which has poor dissipate heat. Moreover, the suction cup gasket which collapse upon contact with the periphery of eyehole so that it is helpful in expelling air out of the suction cup goggles and can achieve an excellent hermetic as well as prevent the seepage of water when the swimming goggles in use. However, the suction cup gasket provides uncomfortable with the skin of the periphery of a eyehole due to the suction cup gasket may cause a persistent negative pressure inside of the gasket and forced the eyeball, especially near the side of the bridge of a swimming goggles was more uncomfortable since the suction cup gasket was transformed and pressed the edge of swimming goggles to forcing the periphery of the eyehole. Further since the suction cup gasket provides a very good hermetic engagement with the periphery of a eyehole when the swimming goggles in use, thereby resulting in more difficult which take off the swimming goggle.

In addition, wearing a swimming goggles, though, is different from wearing a glasses, but it is the same idea which is reduced the weight of a swimming goggles or a glasses to bring down the pressure on a wearer's face and get more comfortable fitting when a swimming goggles or a glasses in use. Conventionally, the lens frame of a swimming goggles is made of a rigid material which is formed integrally, thereby the lens frame of the swimming goggles has quite weight, then further combine with the lens of the swimming goggles will get more weight, so as to influence comfortable fitting in use. It is such the swimming goggles as someone fell it off in water when playing without care, and then the swimming goggles will getting sink in water and can not get back or even never find wherever.

OBJECTS OF THE INVENTION

The object of the present invention is to provide a swimming goggles that can overcome the drawback of the aforementioned prior art.

More specifically, the main object of the present invention is to provide a pair of swimming goggles which has a gasket providing a good hermetic and water leakage-proof attachment to the periphery of a wearer's eyehole and which do not provide a persistent negative pressure inside of the goggles when the swimming goggles are in use, thereby resulting in a good hermetic and comfortable fitting.

Another object of the present invention is to provide a pair of swimming goggles which have a lens frames with a light weight and provides the swimming goggles can be buoy in the water and get more lightness in using.

To achieve the above objects, the present invention is featured in that swimming goggles have two lens frames, each of which has at least one concave cavity that is disposed on a contact side of each lens frame. A gasket which be fixed on each lens frame comprising a foam layer and a resilient layer. The foam layer is attached to the periphery of each lens frame for sealing the concave cavity. And the resilient layer is attached to the foam layer for attachment on the periphery of a wearer's eyehole.

According to the above features of the present invention, the area of the resilient layer is larger than the contact side of the lens frame appreciably. And the resilient layer opposite to the orientation of the lens frame is over the edge of the lens frame such a larger contact side resulting in the resilient layer can compliant to the periphery of a wearer's eyehole, so as to prevent correspondingly the seepage of water.

BRIEF DESCRIPTION OF THE DRAWINGS

Other features and advantages of the present invention will become apparent in the following detailed description of the preferred embodiments with reference to the accompanying drawings of which.

DETAILED DESCRIPTION OF THE PREFERRED EMBODIMENT

Figure 1:
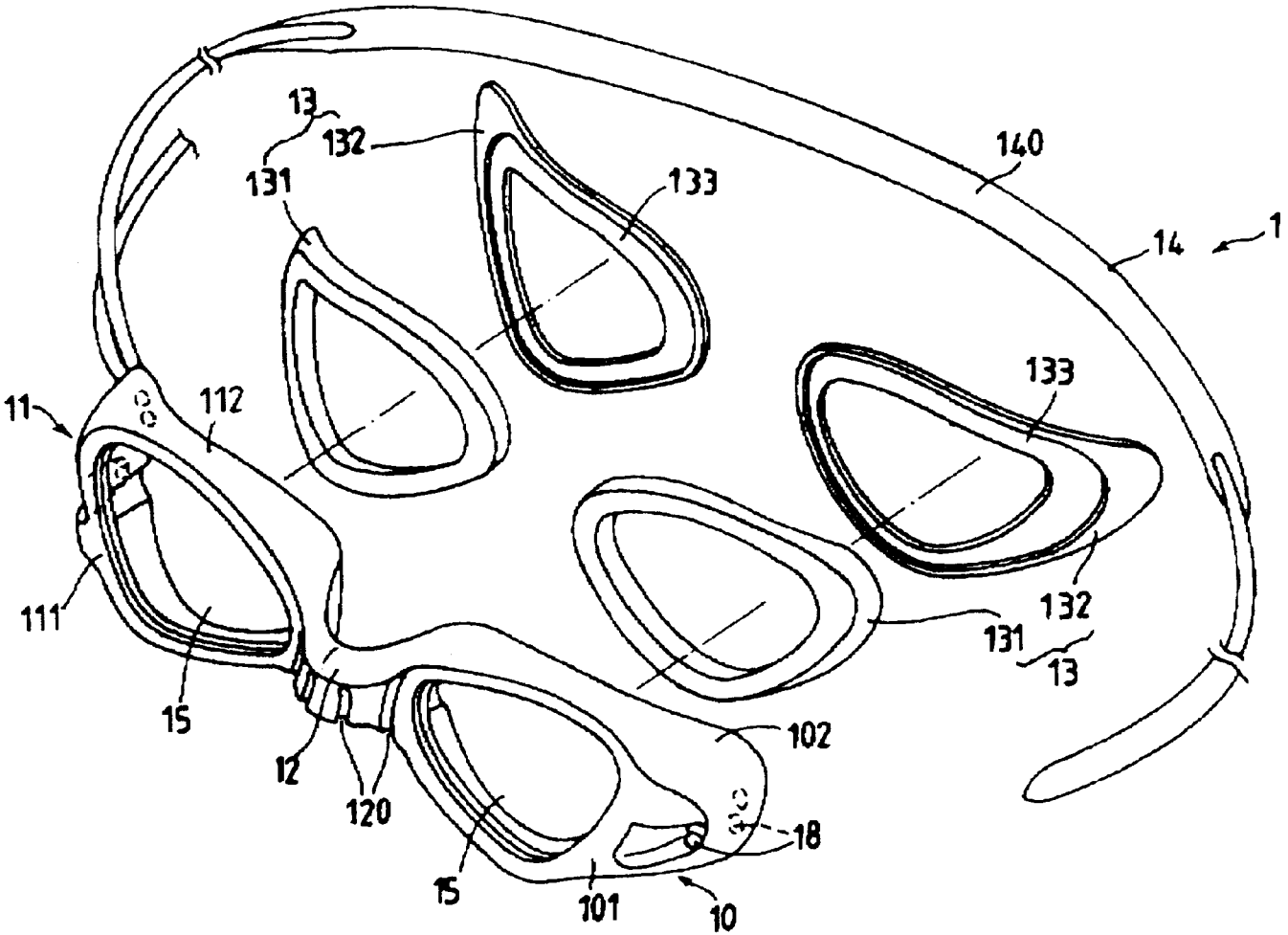
FIG. 1 is a perspective view of the disassembled parts of the swimming goggles of the present invention.
Figure 3:
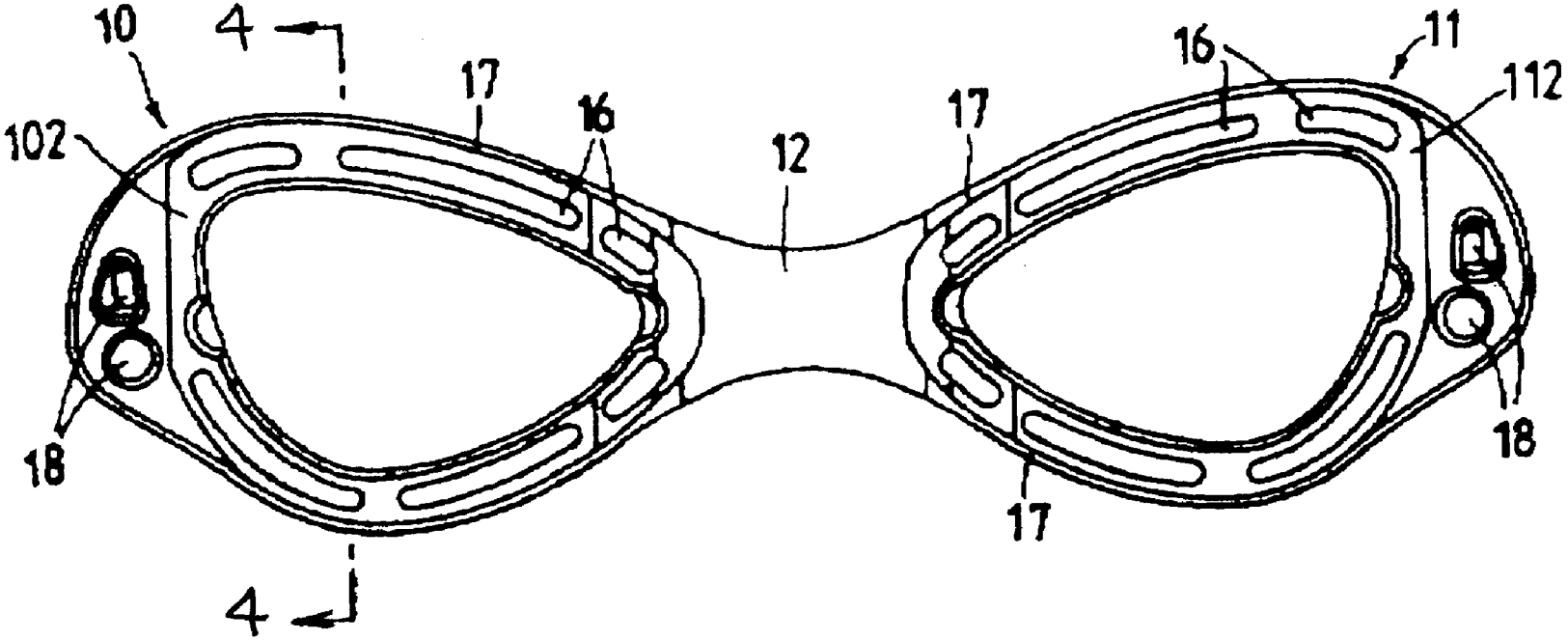
FIG. 3 is a rear view of the lens frame of the swimming goggles of the present invention.
Figure 4:
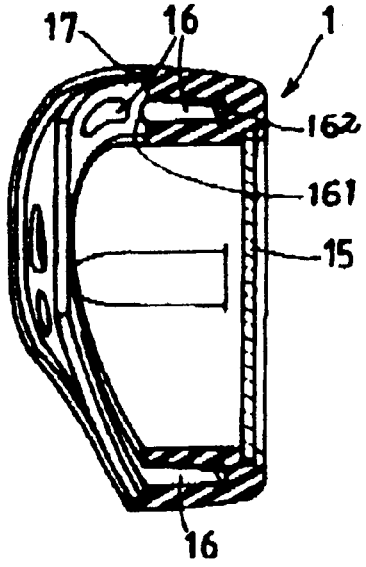
FIG. 4 is a cross-sectional view of the 4—4 section of FIG. 3.

Referring to FIGS. 1, 3 and 4, the preferred embodiment of a swimming goggles 1 according to the present invention is show to comprise two lens frames 10,11 and a nose bridge 12 and two gasket units 13 and a head strap device 14. Each of lens frames 10,11 is formed integrally with the nose bridge 12 in which each of lens frames 10,11 is transparent material that have a front lens frame 101,111 and rear lens frame 102,112, each front lens frame 101,111 which is defined a retaining space for fixing a lens 15. Also each rear lens frame 102,112 has concave cavities 16 each of which is an elongated round and which is formed on a periphery of the rear lens frame 102,112, each of the concave cavities 16 has a opening 161 and a bottom 162 that the width of the opening 161 is larger than the width of the bottom 162 and which are formed a reversal taper together along in cross-section.

Thereby, each of lens frames 10,11 can lose weight by the concave cavities 16 and the swimming goggles 1 will be able to buoy in the water. In FIG. 4 shown, each rear lens frame 102,112 has a lip 17 which is protruded the outer edge of the periphery of each rear lens frame 102,112 to provide the gasket units 13 for securing position thereon. Besides, a strap connecting portion of each rear lens frame 102,112 are two connecting holes 18 integrally formed therewith and passed through each front lens frame 101,111 for a head strap 140 of the head strap device 14.

Figure 2:
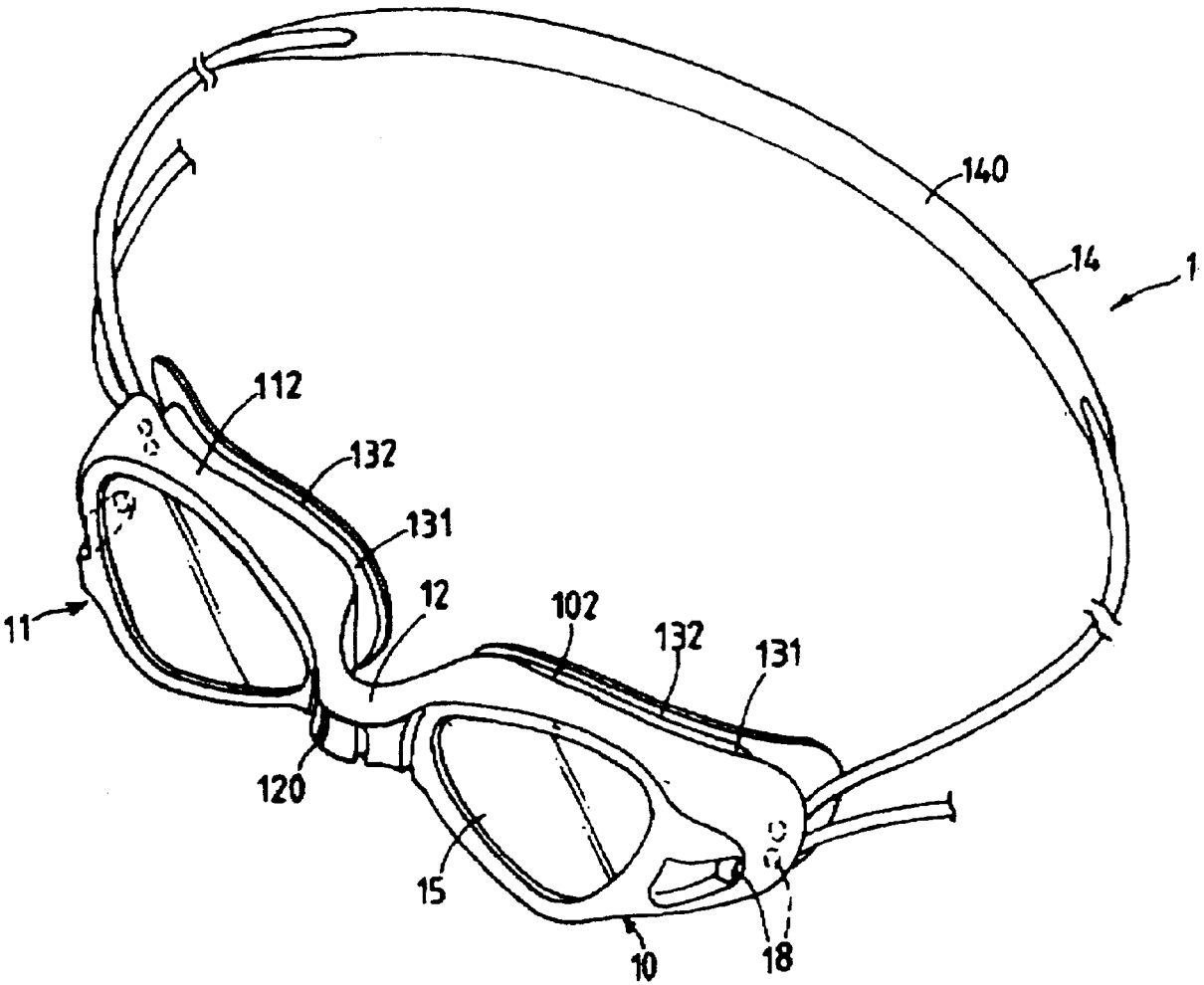
FIG. 2 is a perspective view of the swimming goggles of the present invention.

The gasket units 13 have a foam layer 131 and a resilient layer 132 [in which], the foam layer 131 has overall thickness 50 mm that is attached to the periphery of each rear lens frame 102,112 by adhesive material and is secured within the lip 17 to [provide] seal up the opening 161 of the concave cavity 16. Moreover, the resilient layer 132 is made of thermoplastic plastic which can be compliant to the periphery of a wearer's eyehole and can not cause a persistent negative pressure inside of the gasket when the swimming goggles are in use. The resilient layer 132 has a position slot 133 opposite to the foam layer 131 to provide the foam layer 131 stopping along the inner side of the position slot 133. Please refer to FIG. 2, the resilient layer 132 is over an outer side of each rear lens frame 102, 112, lead to the resilient layer 132 has a larger area to comply with the periphery of a wearer's eyehole and get more better to prevent the seepage of water when the swimming goggles are in use. The head strap 140 have two end that will be respectively passed through the connect holes 18. Also, each of a terminal end portions of the nose bridge 12 is formed with a number of slits 120 that are transverse to a lengthwise direction of the nose bridge, thereby enhancing flexibleness of the nose bridge 12.

Figure 5:
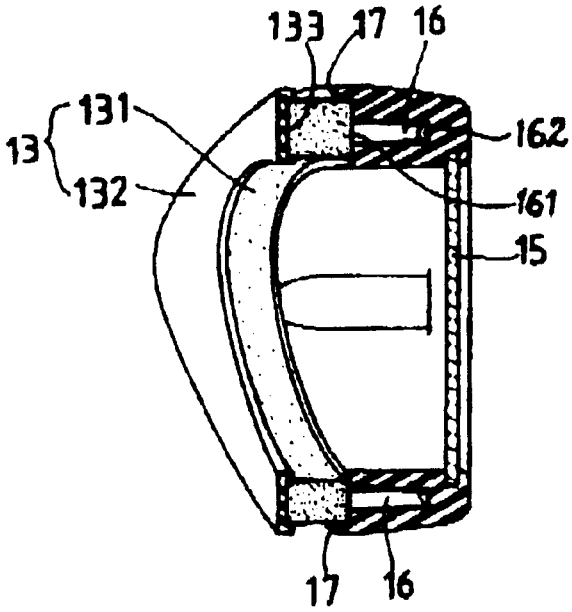
FIG. 5 is a cross-sectional view which are adhered the foam layer and the resilient layer to the lens frame of FIG. 4.

Referencing FIG. 5 and FIG. 1, during assembly, the foam layer 131 is respectively fixed on the periphery of each rear lens frame 102,112 by adhesive material, and then the resilient layer 132 is attached to the foam layer 131, Finally, two free end of the head strap device 14 are respectively passed through the connecting holes 18. Such the swimming goggles 1 can provide a buoy in the water since it is lost weight to each lens frame by the concave cavity. Also the swimming goggles 1 do not provide a persistent negative pressure inside of the goggles because the connect side of gasket units 13 has the resilient layer 132 which can rapidly pressure the gasket to compliantly engage with the periphery of a eyehole and expelled air from inside of the swimming goggles, thereby reducing the gasket to tightly covered with the periphery of a eyehole, so as to resulting in a good hermetic and comfortable fitting when the swimming goggles are in use.

While the present invention has been described in connection with what is considered the most practical and preferred embodiment, it is understood that this invention is not limited to the disclosed embodiments but is intended to cover various arrangements which a head strap is integrally formed with each lens frame respectively, or to change the way of wearing the dual single-eye on the eyehole in use, included within the spirit and scope of the broadest interpretation so as to encompass all such modifications and equivalent arrangements.

What is claimed is:

1. A pair of swimming goggles comprising:

two lens frames, each being made of transparent material and having a front lens frame with a retaining space for a lens, a rear lens frame comprising at least one elongated round concave cavity with an opening and a bottom, a strap connecting portion mounting at an outer side of each of the lens frames;

a nose bridge having two terminal end portions, each respectively connecting inner sides of the lens frames;

two gasket units, each having a foam layer and a resilient layer, the foam layer attached to the rear lens frame for covering the opening and sealing up the concave cavity, the resilient layer is made of thermoplastic plastic attached to the foam layer; and a head strap device connecting outer side of the lens frames.

2. The swimming goggles as claimed in claim 1, wherein the foam layer area is smaller than the rear lens frame area of the lens frame, and the resilient layer area is larger than the rear lens frame area, the resilient layer is opposite of a transverse direction of the lens frame, is over an outer side of the rear lens frame, thereby resulting in the resilient layer having a larger area in order to comply with a wearer's eyehole and to prevent seepage of water when the swimming goggles are in use.

3. The swimming goggles as claimed in claim 2, wherein the concave cavity is a long-rotundity located along the periphery of the rear lens frame.

4. The swimming goggles as claimed in claim 1, wherein a width of the opening is larger than a width of the bottom and forms a reversal taper together in cross-section.

5. The swimming goggles as claimed in claim 4, wherein the resilient layer further comprises a position slot opposite to the foam layer, the foam layer ending along an inner side of the position slot.

6. The swimming goggles as claimed in claim 5, wherein the foam layer has an overall thickness of 50 mm, and the resilient layer is a laminated plastic which is compliant to a periphery of a wearer's eyehole to prevent a persistent negative pressure inside of the gasket.

7. A pair of swimming goggles comprising:

two lens frames, each being made of transparent material and having a front lens frame with a retaining space for a lens, a rear lens frame comprising at least one elongated round concave cavity with an opening and a bottom, a strap connecting portion comprising two connecting holes mounting at an outer side of each of the lens frames;

a nose bridge having transverse slits formed integrally with inner sides of the lens frames;

two gasket units, each having a foam layer and a resilient layer, the foam layer attached to the rear lens frame covering the opening and sealing the concave cavity, the resilient layer made of thermoplastic plastic attached to the foam layer; and a head strap device connected to the two connecting holes.

8. The swimming goggles as claimed in claim 7, wherein the foam layer has an area smaller than an area of the rear lens frame of the lens frame, and the resilient layer has an area larger than the rear lens frame area, the resilient layer is opposite of a transverse direction of the lens frame, is over an outer side of the rear lens frame, thereby resulting in the resilient layer having a larger area in order to comply with a wearer's eyehole and to prevent seepage of water when the swimming goggles are in use.

9. The goggles as claimed in claim 8, wherein the concave cavity is a long-rotundity located along the periphery of the rear lens frame.

10. The swimming goggles as claimed in claim 9, wherein the foam layer has an overall thickness of 50 mm, and the resilient layer is a laminated plastic which is compliant to a periphery of a wearer's eyehole to prevent a persistent negative pressure inside of the gasket.

11. The swimming goggles as claimed in claim 7, wherein a width of the opening is larger than a width of the bottom and forms a reversal taper together in cross-section.

12. The swimming goggles as claimed in claim 7, wherein the resilient layer further comprises a position slot opposite to the foam layer, the foam layer ending along an inner side of the position slot.

13. The swimming goggles as claimed in claim 7, wherein each of the terminal end portions of the nose bridge is formed with a plurality of slits that are transverse to a lengthwise direction of the nose bridge, thereby enhancing the flexibility of the nose bridge.

14. The swimming goggles as claimed in claim 7, wherein the two strap holes are formed through a recess of the rear lens frame.

15. A pair of swimming goggles comprising:

two lens frames, each being made of transparent material and having a front lens frame with a retaining space for a lens, a rear lens frame comprising at least one elongated, round concave cavity with an opening and a bottom, a strap connecting portion comprising two connecting holes mounting at an outer side of each of the lens frames;

a nose bridge having transverse slits formed integrally with inner sides of the lens frames;

two gasket units each comprising a foam layer with a thickness of 50 mm attached to a periphery of each rear lens frame covering the opening and sealing the concave cavity, and a head strap device connected to the two connecting holes.

* * * * *